US007007642B2

(12) United States Patent
Diehl et al.

(10) Patent No.: US 7,007,642 B2
(45) Date of Patent: Mar. 7, 2006

(54) HYDRAULIC VALVE ACTUATOR FOR ACTUATING A GAS-EXCHANGE VALVE

(75) Inventors: Udo Diehl, Stuttgart (DE); Uwe Hammer, Hemmingen (DE); Karsten Mischker, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 47 days.

(21) Appl. No.: 10/493,858

(22) PCT Filed: Mar. 5, 2003

(86) PCT No.: PCT/DE03/00699

§ 371 (c)(1),
(2), (4) Date: Sep. 29, 2004

(87) PCT Pub. No.: WO2004/022929

PCT Pub. Date: Mar. 18, 2004

(65) Prior Publication Data

US 2005/0028763 A1 Feb. 10, 2005

(30) Foreign Application Priority Data

Aug. 29, 2002 (DE) ..... 102 39 747

(51) Int. Cl.
*F01L 9/02* (2006.01)

(52) U.S. Cl. ..... 123/90.12; 123/90.13; 251/12

(58) Field of Classification Search ..... 123/90.12, 123/90.13, 90.16, 90.39, 90.44, 90.48, 90.55; 251/12, 14, 129.03; 137/625.12, 625.13, 137/625.18; 91/405, 406, 440
See application file for complete search history.

(56) References Cited

U.S. PATENT DOCUMENTS

| | | | | |
|---|---|---|---|---|
| 4,930,464 A * | 6/1990 | Letsche | ..... | 123/90.12 |
| 5,231,959 A | 8/1993 | Smietana | | |
| 5,275,136 A | 1/1994 | Schechter | | |
| 5,410,994 A * | 5/1995 | Schechter | ..... | 123/90.12 |
| 6,338,320 B1 | 1/2002 | De Ojeda | | |

FOREIGN PATENT DOCUMENTS

| | | |
|---|---|---|
| DE | 198 26 047 | 12/1999 |
| DE | 102 01 167 | 5/2003 |
| EP | 0 441 100 | 8/1991 |
| EP | 0 767 295 | 4/1997 |

* cited by examiner

*Primary Examiner*—Thomas Denion
*Assistant Examiner*—Ching Chang
(74) *Attorney, Agent, or Firm*—Kenyon & Kenyou

(57) ABSTRACT

An hydraulic valve actuator for actuating a gas-exchange valve in a combustion cylinder of an internal combustion engine has an operating piston delimiting two pressure chambers, of which the lower pressure chamber acting in the valve-closing direction is permanently charged with fluid pressure via which an intake and return line can be charged by, or relieved of, fluid pressure. To brake the gas-exchange valve in the final phase of the closing procedure to reduce the set-down speed, the return line of the upper pressure chamber is split between two discharge openings, which are connected to one another and arranged in the housing with axial clearance, the upper discharge opening being coupled to a restrictor and the lower discharge opening being displaceable relative to the operating piston and disposed in its displacement path such that it may be closed thereby at a defined distance, prior to reaching its upper limit position.

20 Claims, 5 Drawing Sheets

HYDRAULIC VALVE ACTUATOR FOR ACTUATING A GAS-EXCHANGE VALVE

FIELD OF THE INVENTION

The present invention is directed to an hydraulic valve actuator for activating a gas-exchange valve in a combustion cylinder of an internal combustion engine.

BACKGROUND INFORMATION

German Published Patent Application No. 198 26 047 describes a hydraulic valve actuator of this type, which is also referred to as an "actuator". In this actuator, the lower pressure chamber, via which the operating piston is displaced in the direction of valve closing, is continually charged with pressurized fluid. The upper pressure chamber, provided with an intake line and a return line, via which a piston displacement in the direction of valve opening is effected, is selectively charged with pressurized fluid via the intake, using control valves, such as 2/2 solenoid valves, or it is relieved again to approximately ambient pressure via the return line. A regulated pressure-supply device supplies the pressurized fluid. Of the control valves, a first control valve connects the upper pressure chamber to a relief line discharging into a fluid reservoir, and a second control valve connects the upper pressure chamber to the pressure-supply device. In the closed state of the gas exchange valve, the upper pressure chamber is disconnected from the pressure supply device by the closed second control valve and connected to the relief line via the open first control valve, so that the actuating piston is retained in its closed position by the fluid pressure prevailing in the lower pressure chamber. To open the gas exchange valve, the control valves are switched over, so that the upper pressure chamber is cut off from the relief line and connected to the pressure supply device. The gas-exchange valve opens because the effective area of the operating piston delimiting the upper pressure chamber is larger than the effective area of the operating piston delimiting the lower pressure chamber, the magnitude of the opening stroke lift being a function of the generation of the electrical control signal applied to the second control valve, and the opening speed being a function of the fluid pressure applied by the pressure-supply device. To close the gas exchange valve, the control valves are switched over again, thereby connecting the upper pressure chamber, which is blocked off from the pressure supply device, to the relief line. The fluid pressure prevailing in the lower pressure chamber guides the operating piston back into its upper limit position, so that the gas exchange valve is closed by the operating piston.

Such a device requires rapid closing of the gas exchange valve and, at the same time, a low impact speed of the valve member of the gas-exchange valve on the valve seat formed in the cylinder head of the combustion cylinder. For reasons of noise and wear, this speed must not exceed certain limit values.

To this end, the use of a valve brake has been proposed in German Published Patent Application No. 102 01 167.2, which brake is connected to the valve member of the gas-exchange valve or to the valve actuator. The valve brake, which acts during a residual closing stroke of the valve member, includes an hydraulic damping member having a fluid displacement volume that discharges via a throttle opening. In one version, where the damping member is integrated in the valve actuator, the return line of the upper pressure chamber is split between two discharge orifices, which are connected to one another and arranged in the housing with axial clearance. A restrictor is assigned to the upper discharge orifice, and the lower discharge orifice is situated in the displacement path of the operating piston in such a way that it may be closed by the operating piston prior to reaching the upper limit position. The throttle opening is realized by a pressure-controlled restrictor whose control pressure is adjusted as a function of the viscosity of the displacement volume with the aid of an electrically controlled hydraulic pressure valve and an electronic control device that triggers it. This has the advantage that the valve member is decelerated during the closing stroke before it reaches its closed position, the braking effect being independent of the temperature and the resulting viscosity of the fluid volume displaced via the throttle opening. Since the opening cross section of the throttle opening is reduced with increasing temperature and attendant decreasing viscosity, the flow velocity of the displaced fluid volume through the throttle opening is reduced to the same extent, so that the magnitude of the braking of the operating piston via the damping member remains approximately constant.

SUMMARY OF THE INVENTION

The valve actuator according to the present invention for actuating a gas-exchange valve in a combustion cylinder of an internal combustion engine has the advantage that during the closing stroke of the operating piston, that is, with an operating piston moving into its upper limit position, the lower discharge orifice is closed by the operating piston following a certain displacement travel. Thus, the fluid from the upper pressure chamber may only be expelled via the restrictor. This lowers the displacement velocity of the operating piston, so that the gas-exchange valve connected to the operating piston has a reduced closing speed and the valve member subsequently sets down on the valve seat with considerably reduced striking speed. Since the lower discharge opening is situated at a distance from the upper limit position of the operating piston, the braking operation sets in when the valve member of the gas-exchange valve is at a certain distance from the valve seat. The magnitude of the speed reduction may be influenced by adjusting the opening-cross section of the restrictor. If, however, due to manufacturing tolerances of the gas-exchange valve or as a result of different thermal expansions of the valve parts, the lift of the valve member of the gas-exchange valve has changed slightly by the time it sets down on the valve seat of the gas-exchange valve, the displaceable design of the lower discharge opening allows an automatic tolerance compensation. By a corresponding slight shifting of the lower discharge opening, the braking, which is triggered by the closing of the lower discharge opening via the operating piston, sets in with a closing stroke of the operating piston, adapted to the modified valve-member lift, in such a way that in all closing operations of the gas-exchange valve the braking of the valve member always sets in at the same point relative to the distance from the valve member. This means that the valve member is decelerated over a constant, tolerance-independent braking path until it sets down on the valve seat.

According to an embodiment of the present invention, the displaceable design of the lower discharge opening is realized in that the lower discharge opening is made up of a radial bore penetrating the housing and a radial bore, communicating therewith, in a compensation piston, which encloses the operating piston and is displaceable relative to the operating piston. On the one side, the compensation piston, which is designed such that it is carried along by the operating piston moving into the upper limit position, axially delimits the upper pressure chamber together with the operating piston. On the other side, it axially delimits a blockable compensation chamber via its annular end face, which faces away from the upper pressure chamber.

According to a particular embodiment of the present invention, the compensation chamber is blocked off over the displacement path of the operating piston. It is released again for a fluid exchange when the operating piston, moving into its upper limit position, begins to take the compensation piston along. In this way, when the lower discharge opening is closed, the compensation piston is still able to move within certain limits and adjusts the position of the lower discharge opening with respect to the closed position of the gas-exchange valve, the lower discharge opening determining the onset of the braking operation. As a result, the braking always sets in when the valve member is at precisely the same distance in front of the valve seat, regardless of tolerances or thermal expansions occurring in the gas-exchange valve.

According to an alternative embodiment of the present invention, to ensure that an axial displacement of the compensation piston is possible once the operating piston has closed the lower discharge opening, the compensation chamber is connected to a fluid reservoir at least as soon as the compensation piston begins to be taken along by the operating piston moving into its upper limit position. The connection between the compensation chamber and the fluid reservoir may also be permanent; however, the restriction that the connection is established only when the compensation piston is taken along has the advantage that it prevents the compensation piston from being taken along prematurely, as a result of friction between the compensation piston and the operating piston.

Providing the fluid reservoir has the additional advantage that the movement of operating piston out of its upper limit position, which is accompanied by the opening of the gas-exchange valve, takes place with a relatively great displacement force. This force is reduced following a displacement travel determined by the fluid reservoir, namely when no further fluid volume is able to be expelled into the reservoir from the compensation chamber. Reducing the displacement force in the subsequent displacement path of the operating piston saves energy, since the actuating force required for the further opening of the gas-exchange valve following the initial opening of the gas-exchange valve is much lower than the actuating force that is generated during the initial opening of the gas-exchange valve against the high internal pressure in the combustion cylinder.

DETAILED DESCRIPTION

Figure 1:
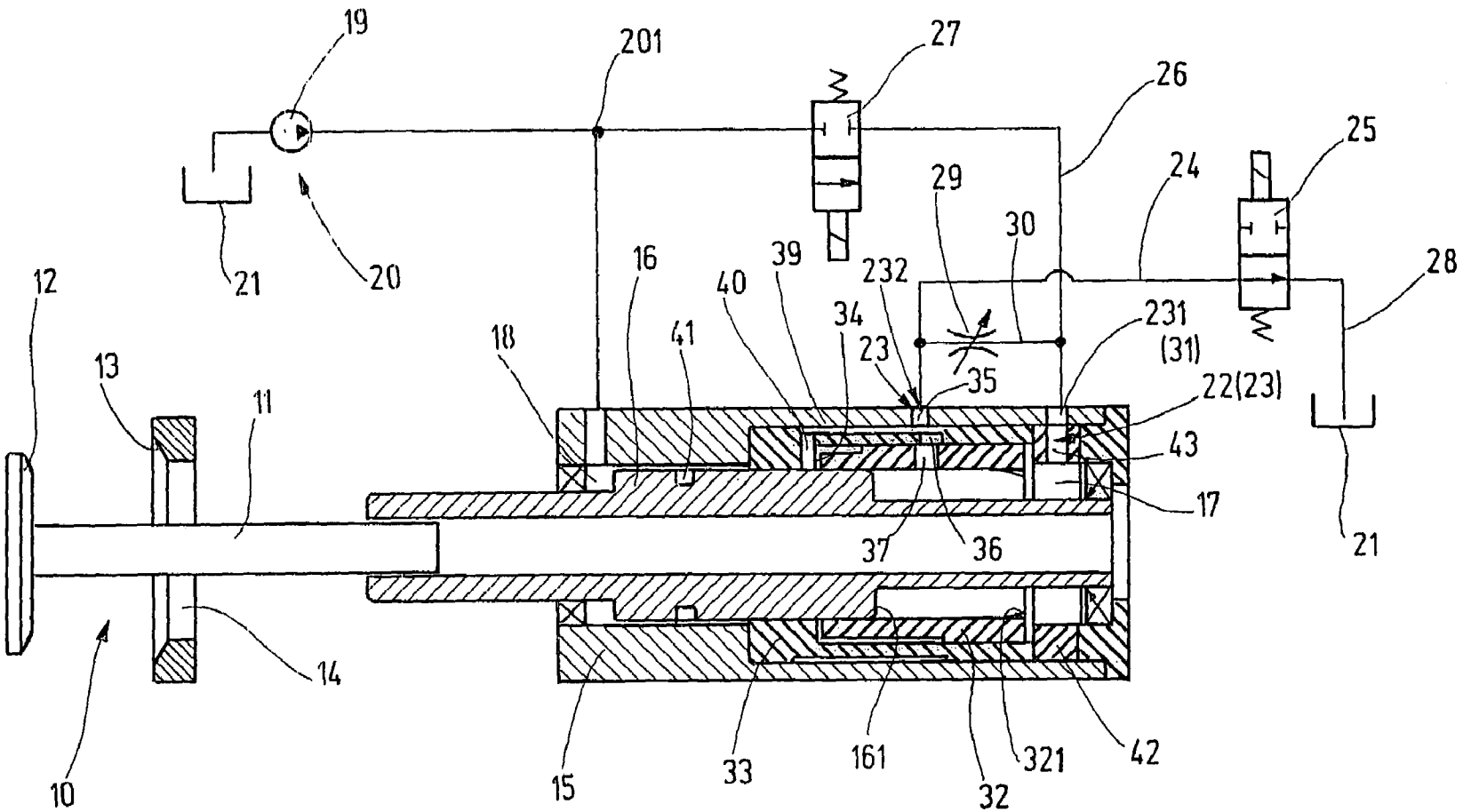
FIG. 1 shows a longitudinal section of a valve actuator connected to a gas-exchange valve according to an embodiment of the present invention, showing a maximally opened gas-exchange valve.

The hydraulic valve actuator schematically shown in longitudinal section in FIG. 1 is used to activate a gas-exchange valve 10 in a combustion cylinder of an internal combustion engine. Gas-exchange valve 10 has a valve shaft 11 and a valve member 12 disposed on the far end of valve shaft 11 relative to the valve actuator, valve member 12 cooperating with a valve seat 13 formed in the cylinder head of the combustion cylinder. Valve seat 13 encloses a valve opening 14, which is closed in a gas-tight manner when valve member 12 sits on valve seat 13. Gas-exchange valve 10 may be an intake valve or a discharge valve of the combustion cylinder.

The valve actuator, also called an actuator, for activating gas-exchange valve 10, which represents a double-acting working cylinder, has a hollow-cylindrical housing 15 and an operating piston 16 guided in housing 15 so as to be displaceable in an axial direction. Operating piston 16 is fixedly connected to valve shaft 11 and, in a displacement limit position shown in FIG. 3 and referred to as upper limit position in the following, holds gas-exchange valve 10 closed. In a displacement limit position, in the following referred to as lower limit position and shown in FIG. 1, it opens gas-exchange valve 10 to the maximum. By effective areas having different sizes, operating piston 16 axially delimits two volume-variable pressure chambers 17, 18 in housing 15. The effective area delimiting the right pressure chamber in FIG. 1, referred to as upper pressure chamber 17 in the following, is larger than the effective area delimiting the left pressure chamber in FIG. 1, referred to as lower pressure chamber 18 in the following. Lower pressure chamber 18 is permanently connected to a pressure-supply device 20, which delivers fluid, such as hydraulic oil, that is under high pressure. Pressure-supply device 20 is represented in simplified form by a high-pressure pump 19, which draws in fluid from a fluid reservoir 21 and provides the fluid, which is raised to high pressure, at output 201 of pressure-supply device 20. As a rule, pressure-supply device 20 also includes a reservoir and a non-return valve. Upper pressure chamber 17 has an intake 22 and a return line 23, return line 23 being connected to a first control valve 25 by way of a return line 24, and intake 22 being connected to a second control valve 27 via an intake line 26. On the output side, first control valve 25 is connected to a return, i.e., relief line 28 leading to fluid reservoir 21, whereas second control valve 27 is connected to output 201 of pressure-supply device 20 on the input side. Both control valves 25, 27 may be embodied as 2/2 solenoid valves having spring return. Return line 23 is coupled to two interconnected discharge openings 231, 232, which are arranged in housing 15 with axial clearance. Upper discharge opening 231 is coupled to a restrictor 29, and lower discharge opening 232 is disposed in the displacement path of operating piston 16 in such a way that operating piston 16 is able to close it at a definable distance prior to reaching the upper limit position. In the exemplary embodiment of FIG. 1, upper discharge opening 231 is simultaneously used as intake 22, so that intake line 26 is connected to upper discharge opening 231. Return line 24 is connected to lower discharge opening 232, and intake and return lines 26, 24 are connected to one another via a connecting line 30 in which restrictor 29 is disposed.

Figure 4:
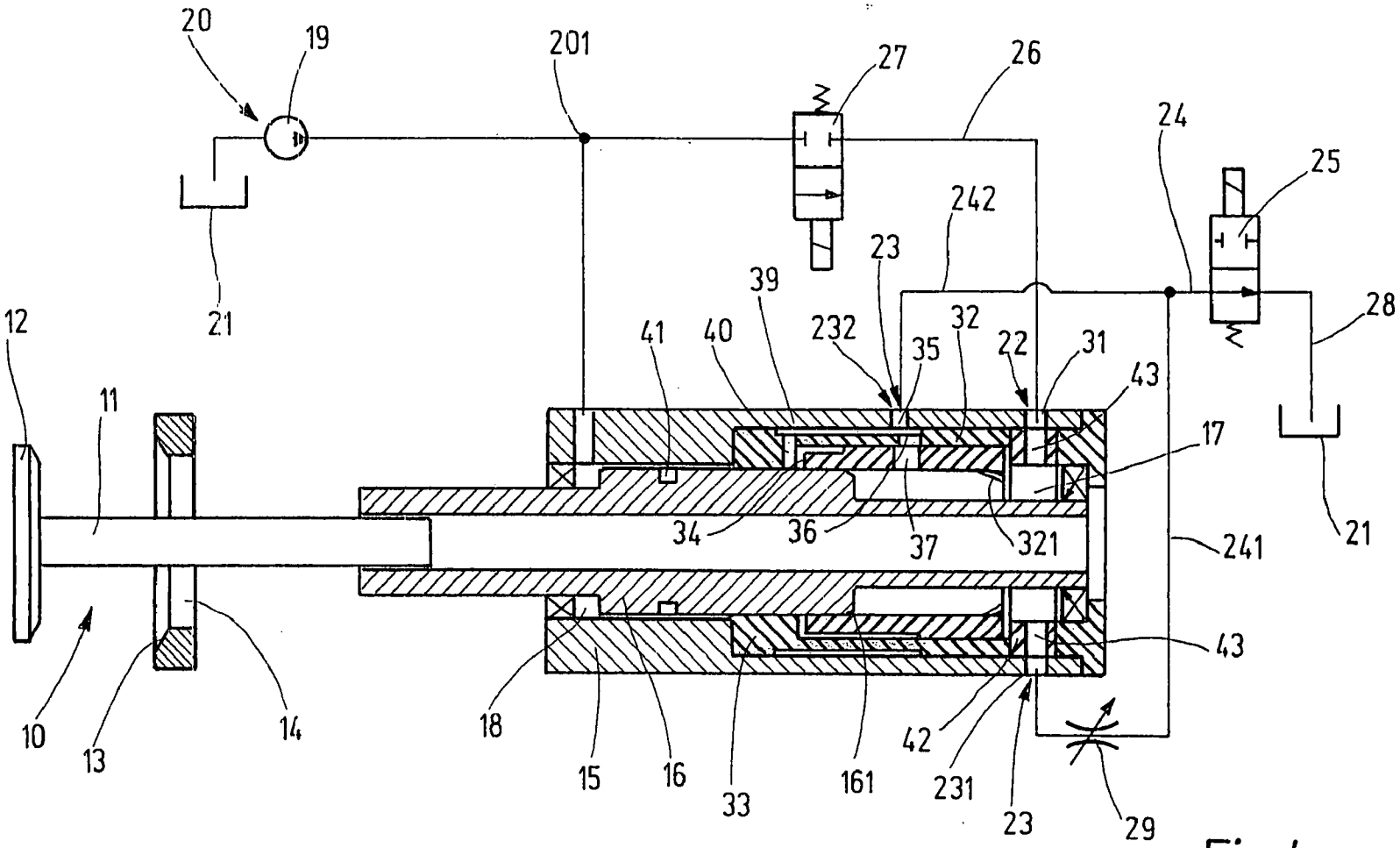
FIG. 4 shows a longitudinal section of an embodiment of a modified valve actuator according to the present invention.

In the exemplary embodiment of FIG. 4, intake 22 is realized by a separate intake opening 31 in housing 15. Return line 24, which is connected to first control valve 25, has two line branches 241, 242, one of which, line branch 241, leads to upper discharge opening 231 and the other, line branch 242, leads to lower discharge opening 232. Restrictor 29, symbolically drawn in in line branch 241, is advantageously realized by designing upper discharge opening 231 as a throttle bore.

Operating piston 16 is enclosed by a compensating piston 32, which is displaceable relative to operating piston 16. Operating piston 16 and compensating piston 32 are guided in a guide sleeve 33 so as to be axially displaceable, guide sleeve 33 being fixed in housing 15 in a non-displaceable manner. Compensating piston 32, together with the effective area of operating piston 16, axially delimits upper pressure chamber 17, and by its annular end face facing away from upper pressure chamber 17 it delimits a compensating chamber 34 in guide sleeve 33. Compensating piston 32 carries a stop 321 near its end facing upper pressure chamber 17, and operating piston 16 carries a counter stop 161 on its end forming the effective area, counter stop 161 cooperating with stop 321 in taking along compensating piston 32 by operating piston 16 moving into the upper limit position.

Figure 3:
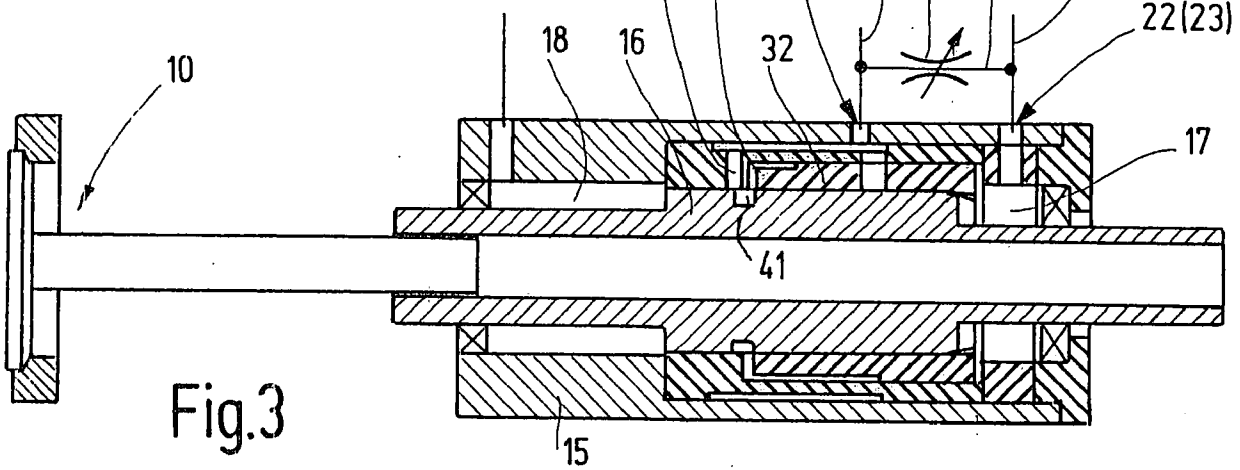
FIG. 3 shows a longitudinal section of a valve actuator connected to a gas-exchange valve according to an embodiment of the present invention as in FIGS. 1 and 2, in this case showing a completely closed gas-exchange valve.

As a result of compensating piston 32 and guide sleeve 33, lower discharge opening 232 is made up of a first radial bore 35 in housing 15, a second radial bore 36 in guide sleeve 33 and a third radial bore 37 in compensating piston 32. Compensating chamber 34 is blocked off over the displacement path of operating piston 16; it is released for fluid discharge or fluid intake only at the point where operating piston 16, moving into its upper limit position, begins to take along compensating piston 32. To this end, a compensation channel 39, which connects second radial bore 36 with a radial bore 40 in guide sleeve 33, is worked into guide sleeve 33, radial bore 40 being set apart from second radial bore 36 and discharging toward operating piston 16. Operating piston 16 has an annular groove 41 having an axial groove width such that, in a certain relative position of operating piston 16 and compensating piston 32, it establishes a connection between the mouth of radial bore 40 and compensating chamber 34. To this end, annular groove 41 is placed on operating piston 16 in such a way that the connection is established as soon as compensating piston 32 begins to be carried along by operating piston 16, i.e., with the stop of counter stop 161 striking stop 321; the connection is severed again only when operating piston 16 has moved slightly out of its upper limit position. In the upper limit position of operating piston 16, the connection between compensating chamber 34 and radial bore 40 is maintained via annular groove 41, as can be seen in FIG. 3.

Inside upper pressure chamber 17, a spacer sleeve 42, which forms a stop for compensating piston 32, is inserted in housing 15. Compensating piston 32 can thus move between the floor of compensating chamber 34, which is formed by guide sleeve 33, and spacer sleeve 42. Since spacer sleeve 42 is located in the region of upper discharge opening 231 and intake opening 31, spacer sleeve 42 is provided with a radial bore 43, as shown in FIG. 1, which corresponds to upper intake opening 231 or to discharge opening 31, which is identical therewith. In the separate design of upper discharge opening 231 and intake opening 31 according to FIG. 4, two radial bores 43 are provided, one of which is aligned with upper discharge opening 231 and one with intake opening 31.

The operation of the hydraulic valve actuator is as follows:

In FIG. 1, the valve actuator is shown with operating piston 16 in its lower limit position in which gas-exchange valve 10 is opened to its maximum. To close gas-exchange valve 10, control valves 25, 27 are switched over into their position shown in FIG. 1. First control valve 25 is open and upper pressure chamber 17 is thereby connected to fluid reservoir 21 via return line 23 (upper and lower discharge opening 231, 232), return line 24 and relief line 28. Second control valve 27 is closed. Since lower pressure chamber 18 is pressurized at all times by the fluid pressure generated by pressure-supply device 20, operating piston 16 is moved to the right in FIG. 1, and gas-exchange valve 10 moves in the closing direction. In the process, fluid is expelled from upper pressure chamber 17. On one side, the fluid flows off into return line 24 via lower discharge opening 232 and, on the other side, via upper discharge opening 231 and restrictor 29, reaching fluid reservoir 21 via relief line 28.

In the further course of the closing movement of gas-exchange valve 10, operating piston 16 passes over radial bore 37 in compensating piston 32, thereby closing off lower discharge opening 232. Now, the fluid can discharge into return line 24 solely via upper discharge opening 231 and via restrictor 29. Only a small fluid quantity per time unit is able to flow off through restrictor 29, so that operating piston 16 and gas-exchange valve 10 are decelerated. Operating piston 16 continues a displacement movement into its upper limit position—now at reduced speed—until gas-exchange valve 10 is closed, that is to say, until valve member 12 sets down on valve seat 13.

The displacement stroke in which the deceleration of operating piston 16 begins depends on the relative position of operating piston 16 with respect to compensating piston 32. Compensating piston 32 is able to move between the base of compensating chamber 34 and spacer sleeve 42. When the internal combustion engine is started up, or during a starting procedure after the internal combustion engine has been at a standstill for a longer period of time, compensating piston 32 assumes an arbitrary position between chamber base and spacer sleeve 42. If compensating piston 32 is located too far to the left in the representation in FIG. 1, operating piston 16 strikes stop 321 of compensating piston 32 during valve closing by way of its counter stop 161. At this moment, annular groove 41 in operating piston 16 establishes a connection between compensating chamber 34, also filled with fluid, and radial bore 40 in guide sleeve 33, which in turn is in connection with lower discharge opening 232 via compensating channel 39. Compensating piston 32 is now able to move. Operating piston 16, taking compensating piston 32 along, continues to move until valve member 12 of gas-exchange valve 10 is sealingly positioned on valve seat 13. Since compensating piston 32 is carried along, the connection between compensating chamber 34 and lower discharge opening 232 is maintained via annular groove 41 (FIG. 3).

To open gas-exchange valve 10, first control valve 25 is closed and second control valve 27 opened. Upper pressure chamber 17 is now under the fluid pressure supplied by pressure-supply device 20. Since the effective area of operating piston 16 delimiting upper pressure chamber 17 is larger than the effective area of operating piston 16 delimiting lower pressure chamber 18, operating piston 16 moves to the left in the graphical representation, and gas-exchange valve 10 is opened. Via annular groove 41, compensating chamber 34 is connected to lower discharge opening 232 and the latter is connected to upper pressure chamber 17 via restrictor 29, so that compensating chamber 34 has the same pressure as upper pressure chamber 17. Since the two effective areas of compensating piston 32 that delimit compensating chamber 34 and upper pressure chamber 17 are of the same size, compensating piston 32 is pressure-equalized, so that no resulting displacement force is generated at compensating piston 32. However, the pressure in compensating chamber 34 is generated somewhat later because of restrictor 29, so that compensating piston 32 makes a slight movement to the left. As soon as operating piston 16 has moved to such an extent that annular groove 41 breaks off the connection to compensating chamber 34, compensating chamber 34 is blocked off, so that compensating piston 32 remains in the attained position. In this way, compensating piston 32 is aligned, and radial bore 37 in compensating piston 32, which is part of lower discharge opening 232, has a fixed position with respect to the closed state of gas-exchange valve 10. As a result, operating piston 16 always closes radial bore 37 at a fixed distance prior to reaching its limit position, and the braking operation at gas-exchange vale 10 thus always begins when valve member 12 is at a fixed distance from valve seat 13. If compensating piston 32 is too far to the right in the closing operation shown in the representation of FIGS. 1 to 3, compensating piston 32 is adjusted as described during the subsequent closing and opening operation of gas-exchange valve 10 in that compensating piston 32 executes a slight movement to the left.

Figure 2:
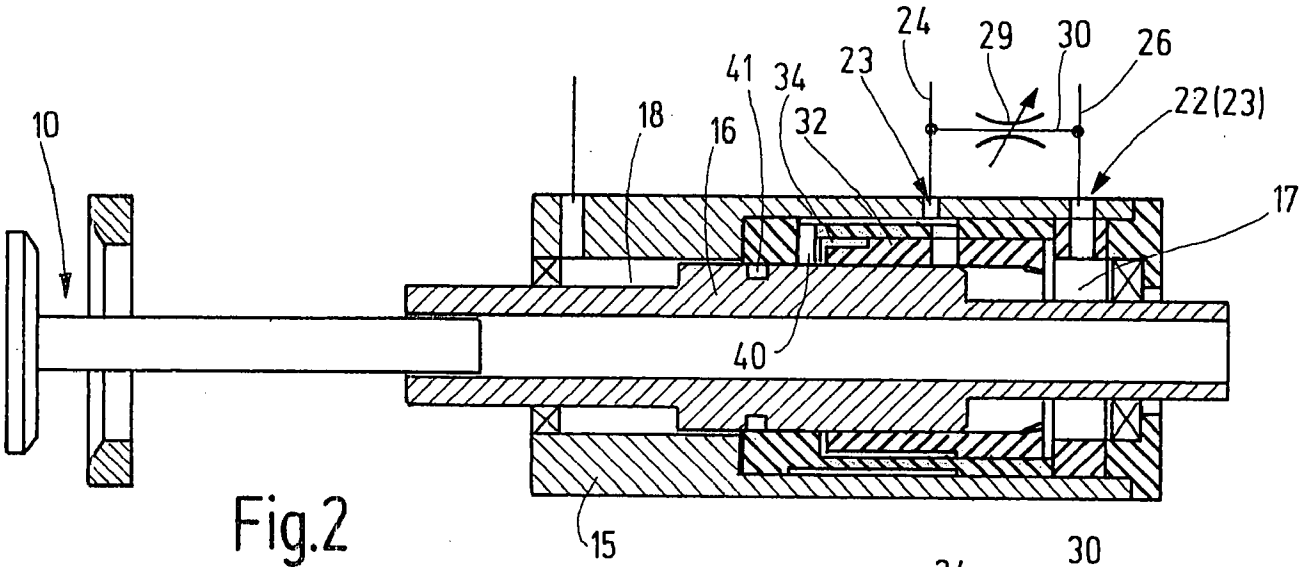
FIG. 2 shows a longitudinal section of a valve actuator connected to a gas-exchange valve according to an embodiment of the present invention as in FIG. 1, in this case showing the braking onset of the gas-exchange valve.
Figure 5:
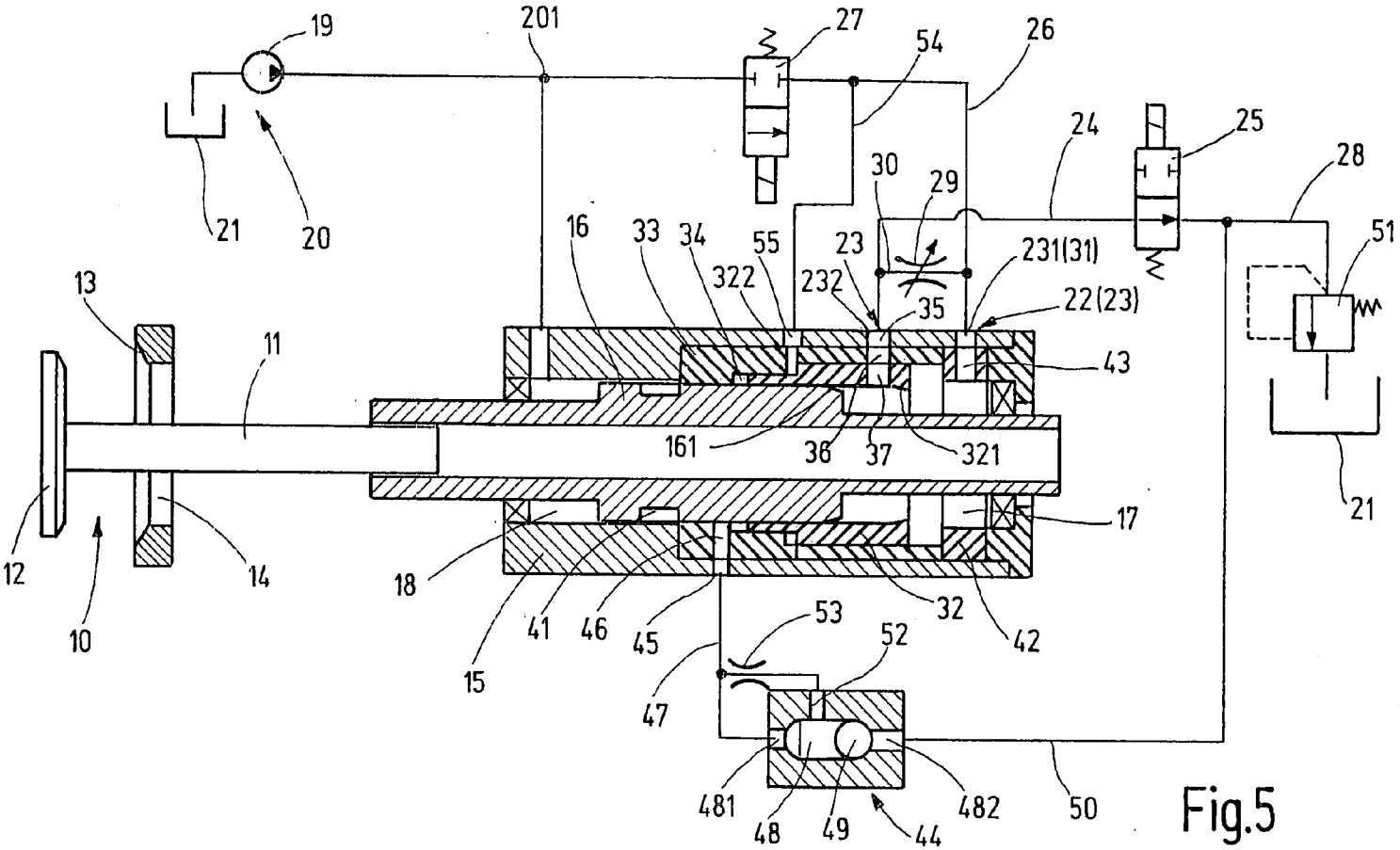
FIG. 5 shows a longitudinal section of a valve actuator connected to a gas-exchange valve according to an embodiment of the present invention, showing a maximally opened gas-exchange valve.
Figure 6:
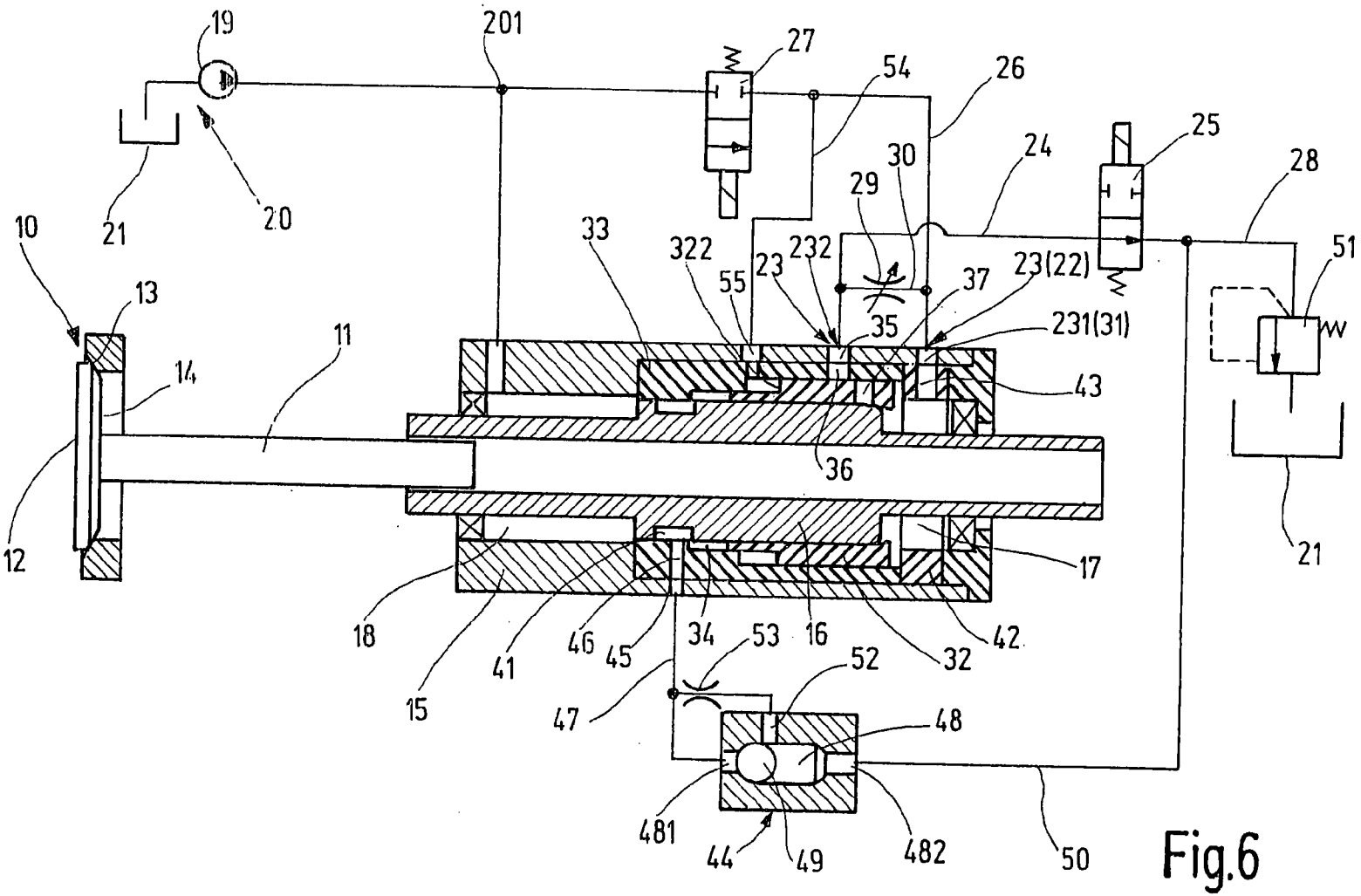
FIG. 6 shows a longitudinal section of a valve actuator connected to a gas-exchange valve according to an embodiment of the present invention as in FIG. 5, in this case showing a completely closed gas-exchange valve.

The valve actuator for a gas-exchange valve 10 shown in, FIGS. 5 and 6 conforms to the previously described valve actuator in design and functioning method, so that identical components bear matching reference numerals in this regard. Due to a constructive measure, this valve actuator has the additional advantage that it opens gas-exchange valve 10 with high actuating force, so that valve member 12 lifts off from valve seat 13 in a rapid and reliable manner, against the high internal pressure in the combustion cylinder of the internal combustion engine, and that it continues to displace valve member 12 with a low actuating force once valve member 12 has lifted off from valve seat 13 and the internal pressure in the combustion cylinder has collapsed as a result. For this purpose, compensating chamber 34, delimited in guide sleeve 33 by compensating piston 32, is not connectable to return line 23 via annular groove 41 in operating piston 16, as shown in FIGS. 1 to 3, but to a fluid reservoir 44, which both accommodates a fluid volume from compensating chamber 34 and also fills this fluid volume into compensating chamber 34. For this purpose, housing 15 and guide sleeve 33 are provided with two mutually aligned radial bores 45, 46, which are connected to a connecting line 47 that leads to fluid reservoir 44. In the exemplary embodiment shown, fluid reservoir 44 is designed as a separate component, but it may also be integrated into housing 15 of the valve actuator. The connection between compensating chamber 34 and fluid reservoir 44 is established via annular groove 41 again, at the instant when compensating piston 32 is carried along by operating piston 16 moving into its upper limit position, that is to say, when counter stop 161 on operating piston 16 strikes stop 321 on compensating piston 32.

Fluid reservoir 44 has a control chamber 48 provided with two chamber openings 481, 482 lying axially opposite one another, and a control member 49, which is axially displaceable in control chamber 48 for the alternate closing of the two chamber openings 481, 482. Connected to one chamber opening, 481, is connecting line 47 leading to radial bore 45 in housing 15, whereas the other chamber opening, 482, is connected to relief line 28 via a connecting line. The connection to relief line 28 is provided in a line section between the output of first control valve 25 and a pressure-modulation valve 51 disposed in relief line 28. Pressure-modulation valve 51 ensures that a slight fluid pressure of approximately 0.1 Mpa is always present at chamber opening 481. In the exemplary embodiment of fluid reservoir 44 shown in FIGS. 5 and 6, control member 49 is embodied as a ball, which is able to alternately set down on a frustoconical valve seat situated upstream from each chamber opening 481 and 482, and is thus able to close chamber openings 481, 482. Also introduced in control chamber 48 is a radial bore 52, which is connected to connecting line 47 via a throttle 53. Radial bore 52 is placed in control chamber 48 in such a way that it lies near chamber opening 481, but is not covered by control member 49 when control member 49 closes chamber opening 481.

The manner of operation of the valve actuator is as follows:

During closing of the gas-exchange valves, control valves 25, 27 assume the position shown in FIG. 5, and the closing movement of gas-exchange valve 10 takes place as described in connection with FIGS. 1 to 3. In the process, operating piston 16, which delimits upper pressure chamber 17, expels fluid from upper pressure chamber 17 via lower discharge opening 232 and via upper discharge opening 231 with downstream restrictor 29. As soon as control piston 16 passes lower discharge opening 232, more specifically, radial bore 37 in compensating piston 32 associated therewith, the braking operation commences during valve closing, due to the fact that the fluid now drains solely via restrictor 29. With the closing of lower discharge opening 232, counter stop 161 on operating piston 16 strikes against stop 321 on compensating piston 32, and operating piston 16 takes compensating piston along in its further displacement travel into upper limit position. Due to the enlarged piston area (operating piston 16 and compensating piston 32) now delimiting upper pressure chamber 17, the braking effect is increased, since, in addition, more fluid must now flow through restrictor 29. Compensating chamber 24 is enlarged by the displacement of compensating piston 32, and since annular groove 41 in operating piston 16 has established the connection between control chamber 48 and compensating chamber 34, fluid is flowing from control chamber 48 into compensating chamber 34. Via chamber opening 482, fluid flows from relief line 28 into control chamber 48, and spherical control member 49 moves to the left in the illustration until it comes to rest on the valve seat associated with chamber opening 481 and seals it. If compensating piston 32 must still move further to the right in the illustration for the complete closing of gas-exchange valve 10, fluid is able to reach compensating chamber 34 via radial bore 52 and throttle 53. Once gas-exchange valve 10 is closed completely, operating piston 16 assumes its upper limit position (FIG. 6) in which the connection between compensating chamber 34 and control chamber 48 is maintained via annular groove 41.

To open gas-exchange valve 10, the two control valves 25, 27 are switched over, so that first control valve 25 closes and second control valve 27 opens. Fluid pressure builds up in upper pressure chamber 17, which acts on the effective area of operating piston 16 and on the end face of compensating piston 32. The sum of the effective areas of operating piston 16 and compensating piston 32 results in a high displacement force in the opening direction of gas-exchange valve 10. Compensating chamber 34 is reduced in size by the displacement movement of compensating piston 32. The fluid is expelled into control chamber 48, which causes spherical control member 49 to move to the right in control chamber 48. The fluid present in control chamber 48 is expelled into relief line 28 via chamber opening 482. Via radial bore 52, fluid may also briefly flow from compensation chamber 32 directly into relief line 28, but throttle 53 ensures that this is only a very small fluid quantity. With the aid of a non-return valve assigned to throttle 53, this slight flow of fluid may be cut off completely. As soon as control member 49 closes other chamber opening 482, no further fluid is able to be expelled from compensating chamber 34 and compensating piston 32 is unable to execute any further displacement movement. Via the volume in control chamber 48, the displacement travel of compensating piston 32 may thus be adjusted.

As soon as compensating piston 32 is in a fixed position, operating piston 16, which continues to move, lifts off from compensating piston 32. The displacement force acting on operating piston 16 is substantially reduced, since it is only the effective area of operating piston 16 delimiting upper pressure chamber 17 that generates the displacement force.

Since compensating piston 32 is taken along by operating piston 16 during closing of gas-exchange valve 10 until valve member 12 comes to rest against valve seat 13, and since compensating piston 32 may travel only a certain displacement path during opening with the aid of control chamber 48, it is ensured that lower discharge opening 232, which controls the braking onset during closing of gas-exchange valve 10, is always in the same position, regardless of thermal expansions and manufacturing tolerances. As a result, the braking onset does not vary.

Shoulder 322 on compensating piston 32, which can still be seen in FIGS. 5 and 6 and which is able to be charged with fluid pressure from intake line 26 via a connecting line 54 and a radial through-hole 55 through housing 15 and guide sleeve 33, is provided for the purpose of increasing the wall thickness of compensating piston 32 across a broad region of compensating piston 32, so as to attain a better manufacturability. Theoretically, the outer diameter of compensating piston 32 may also be produced without this shoulder 322, if the desired force ratio during the initial opening of gas-exchange valve 10 and the subsequent further opening of gas-exchange valve 10 allows a sufficiently large wall thickness of compensating piston 32.

The constructive design of the valve actuator illustrated in FIGS. 5 and 6 may be modified in such a way that annular groove 41 in operating piston 16 is dispensed with and compensating chamber 34 is permanently connected to control chamber 48. This does not affect the operating mode of the valve actuator. However, it is possible that compensating piston 32 is carried along prematurely as a result of friction between compensating piston 32 and operating piston 16. However, this can be avoided by observing the manufacturing tolerances.

The invention claimed is:

1. An hydraulic valve actuator for activating a gas-exchange valve in a combustion cylinder of an internal combustion engine, comprising:

a housing;

an operating piston accommodated in the housing, the operating piston being axially displaceable within the housing to an upper limit position which closes the gas-exchange valve and to a lower limit position which maximally opens the gas-exchange valve;

an intake line;

a return line having upper and lower discharge openings that are mutually connected and are disposed in the housing with axial clearance;

lower and upper variable-volume pressure chambers axially delimited by the operating piston, the lower pressure chamber being delimited by a first effective area of the operating piston and being situated so as to be permanently acted on by fluid pressure, the upper pressure chamber being delimited by a second effective area of the operating piston and situated to enable alternate pressurization and depressurization via the intake line and the return line, the first effective area being smaller than the second effective area; and a restrictor coupled to the upper discharge opening;

wherein the lower discharge opening is disposed in the displacement path of the operating piston such that the lower discharge opening is closed by the operating piston before the operating piston reaches the upper limit position, and wherein the lower discharge opening is axially displaceable relative to the operating piston.

2. The hydraulic valve actuator of claim 1, further comprising:

a compensating piston enclosing the operating piston and displaceable relative to the operating piston, the compensating piston being configured to be carried along by the operating piston as the operating piston moves into the upper limit position; and a sealable compensating chamber;

wherein the lower discharge opening has a first radial bore penetrating the housing, and a second radial bore communicating with the first radial bore is positioned in the compensating piston; and wherein the compensating piston, together with the operating piston, axially delimits the upper pressure chamber in the housing on a first end of the compensating piston, and axially delimits the sealable compensating chamber on a second end of the compensating piston opposite from the first end.

3. The hydraulic valve actuator of claim 2, wherein the compensating piston includes a stop at the first end facing the upper pressure chamber, and the operating piston includes a counter stop corresponding to the stop, enabling cooperative contact between the operating piston and the compensating piston.

4. The hydraulic valve actuator of claim 3, wherein the compensating chamber is blocked across the displacement path of the operating piston and is released for a fluid exchange as the operating piston moves into its upper limit position.

5. The hydraulic valve actuator of claim 4, wherein the operating piston includes an annular groove via which the compensating chamber is connectable to a compensating channel that discharges in the lower discharge opening, an axial width of the annular groove being dimensioned such that the connection between the compensating chamber and the compensating channel is interrupted once the operating piston moves out of the upper limit position.

6. The hydraulic valve actuator of claim 5, wherein an axial clearance between the annular groove and the counter stop on the operating piston is dimensioned such that, when the stop on the compensating piston and the counter stop on the operating piston come into contact, connection between the compensating chamber and the compensating channel is established via the annular groove.

7. The hydraulic valve actuator of claim 3, wherein the compensating chamber is configured to be connected to a fluid reservoir once the compensating piston begins to be carried by the operating piston as the operating piston moves into the upper limit position.

8. The hydraulic valve actuator of claim 7, wherein the compensating chamber is configured to be permanently connected to the fluid reservoir.

9. The hydraulic valve actuator of claim 7, wherein the operating piston includes an annular groove positioned to establish a connection to the fluid reservoir when contact is made between the stop of the compensating piston and the counter stop of the operating piston.

10. The hydraulic valve actuator of claim 9, wherein the housing includes a radial bore connected to the fluid reservoir, and an axial groove width of the annular groove is dimensioned such that the annular groove is connectable to an outlet of the radial bore and the compensating chamber.

11. The hydraulic valve actuator of claim 10, wherein the fluid reservoir includes a control chamber having two chamber openings lying axially opposite one another and a control member axially displaceable in the control chamber, wherein the control member alternately closes one chamber opening and releases the other chamber opening, a first of the two chamber openings being connected to the radial bore in the housing and a second of the two chamber openings being configured to be acted on by a fluid pressure that is slightly greater than a fluid pressure prevailing in the compensating chamber when the operating piston is in the upper limit position.

12. The hydraulic valve actuator of claim 11, wherein the control chamber is connected to the radial bore in the housing via a throttle.

13. The hydraulic valve actuator of claim 11, wherein each of the two chamber openings includes a frustoconical valve seat and the control member is configured as a ball.

14. The hydraulic valve actuator of claims claim 11, wherein a pressure-modulating valve having an output is disposed between the first control valve and the fluid reservoir, and the second of the two chamber openings of the control chamber is connected to the output of the pressure-modulating valve.

15. The hydraulic valve actuator of claim 11, wherein the upper pressure chamber is connected to the intake line configured to be alternatively shut off via a second control valve and connected to a pressure-supply device delivering fluid under high pressure.

16. The hydraulic valve actuator of claim 3, wherein a stop is situated in the upper pressure chamber to delimit displacement of the compensating piston.

17. The hydraulic valve actuator as recited in claim 16, wherein the stop in the upper pressure chamber includes a spacer ring having a radial bore corresponding to the upper discharge opening in the housing.

18. The hydraulic valve actuator of claim 17, wherein one of the upper discharge opening and the radial bore is configured as a throttle bore forming a restrictor, and the lower discharge opening and the upper discharge opening are each connected to one of two line branches of the return line.

19. The hydraulic valve actuator of claim 18, wherein the return line is configured to be alternatively shut off via a first control valve and connected to a fluid reservoir.

20. The hydraulic valve actuator of claim 17, wherein the upper discharge opening simultaneously forms an intake and is connected to the intake line, the lower discharge opening is connected to the return line and the restrictor is disposed in a connecting line coupled to the intake line and to the return line.

* * * * *